US006798344B2

(12) United States Patent
Faulkner et al.

(10) Patent No.: US 6,798,344 B2
(45) **Date of Patent: *Sep. 28, 2004**

(54) SECURITY ALARM SYSTEM AND METHOD WITH REALTIME STREAMING VIDEO

(76) Inventors: James Otis Faulkner, 117 Mimosa Dr., Cambridge, MD (US) 21613; Richard Matyel Blake, 54 Algonquin Rd., Cambridge, MD (US) 21613

( * ) Notice: Subject to any disclaimer, the term of this patent is extended or adjusted under 35 U.S.C. 154(b) by 0 days.

This patent is subject to a terminal disclaimer.

(21) Appl. No.: 10/271,744

(22) Filed: Oct. 17, 2002

(65) Prior Publication Data

US 2004/0004542 A1 Jan. 8, 2004

Related U.S. Application Data

(60) Provisional application No. 60/393,942, filed on Jul. 8, 2002.

(51) Int. Cl.[7] ..... G08B 13/00

(52) U.S. Cl. ..... 340/541; 348/143; 340/565; 340/567

(58) Field of Search ..... 340/541, 565, 340/567; 348/143, 152, 153, 159, 162, 164

(56) References Cited

U.S. PATENT DOCUMENTS 5,694,867 A * 12/1997 Diaz-Lopez ..... 109/6
5,926,210 A * 7/1999 Hackett et al. ..... 348/158
6,400,265 B1 6/2002 Saylor et al.
6,476,858 B1 11/2002 Ramirez Diaz et al.
6,504,479 B1 1/2003 Lemons et al.
6,559,769 B2 * 5/2003 Anthony et al. ..... 340/541 X
2002/0005894 A1 * 1/2002 Foodman et al. ..... 348/143
2002/0018124 A1 2/2002 Mottur et al.
2002/0106998 A1 * 8/2002 Presley et al. ..... 455/403
2002/0147982 A1 10/2002 Naidoo et al.
2003/0041330 A1 * 2/2003 Smith ..... 725/105
2003/0086000 A1 * 5/2003 Siemens et al. ..... 348/148
2003/0094541 A1 * 5/2003 Zeineh ..... 244/118.5
2003/0117494 A1 * 6/2003 Poblete ..... 348/148

OTHER PUBLICATIONS

Screenshot of www.livewave.com, Digital Video and Control Systems.

* cited by examiner

*Primary Examiner*—Thomas J Mullen, Jr.
(74) *Attorney, Agent, or Firm*—McKenna, Long & Aldridge LLP

(57) ABSTRACT

A security alarm system that provides secure, realtime video of a secured location to one or more emergency response agencies over a high-speed communications link, such as an Internet link. Realtime video information is therefore placed directly into the hands of those who are called upon and trained to respond to a potential emergency. As such, the emergency response agencies and their personnel are better informed. This, in turn, allows the personnel to be better prepared in their response to the potential emergency, saving manpower, money, lives and reducing the number of false alarms.

16 Claims, 5 Drawing Sheets

SECURITY ALARM SYSTEM AND METHOD WITH REALTIME STREAMING VIDEO

This application claims priority from U.S. patent application No. 60/393,942 which was filed on Jul. 8, 2002.

BACKGROUND OF THE INVENTION

1. Field of the Invention

The present invention is directed to security alarm systems, including residential and commercial security alarm systems. More particularly, the present invention involves enhancing security alarm systems through the use of realtime video.

2. Background Information

Security alarm systems are widely used to protect property as well as personal safety. Typically, these systems do so by generating an alarm in response to any number of events, such as unauthorized entry, fire, a medical emergency or manual alarm activation. Some systems provide a service which remotely monitors the status of the security alarm system. Thus, if the security alarm system generates an alarm, an alarm notification signal is transmitted via a hardwire and/or wireless communications link to a central station. Upon receiving the alarm notification signal, security service personnel at the central station may attempt to contact the client (i.e., the party at the secured location) to verify the alarm. If it is appropriate to do so, the security service personnel may, upon confirmation of the alarm, contact an emergency response agency (e.g., the police department, the fire department or an emergency medical team).

More recently, security services have added video capability to their security alarm systems. Thus, in addition to transmitting an alarm notification signal, the security alarm system also transmits a video signal to the central station. Like the alarm notification signal, the video signal is transmitted from the secured location to the central station over a hardwire and/or wireless connection. While video does provide additional information, the value of that additional information is of limited value if it is not available to the appropriate emergency response agency or agencies and their highly trained professional emergency response personnel.

SUMMARY OF THE INVENTION

The present invention enhances security alarm systems and services by providing secure, realtime video for the appropriate emergency response agency, or agencies. This enhancement places realtime video information directly into the hands of those who are called upon and trained to respond to potential emergencies. These agencies and their personnel are then better informed. This, in turn, allows them to be better prepared in their response to such emergencies.

Therefore, it is an object of the present invention to provide an enhanced security alarm system with realtime video capability.

It is also an object of the present invention to provide the appropriate emergency response agency or agencies with realtime video so emergency response agency personnel are better informed with respect to a potential emergency.

It is still another object of the present invention to provide the appropriate emergency response agency or agencies with realtime video so emergency response agency personnel can better assess a potential emergency and make proper decisions regarding response strategies, manpower and equipment.

In accordance with a first embodiment of the present invention, the aforementioned and other objectives are achieved through a security alarm system that includes a video camera and an alarm sensor. The video camera and the alarm sensor are positioned at a secured location. The security alarm system also includes a central station with means for processing and displaying realtime video generated by the video camera and received over a communications link. The security alarm system further includes an emergency response agency with means for processing and displaying realtime video generated by the video camera and received over a communications link.

In accordance with another embodiment of the present invention, the aforementioned and other objectives are achieved through a security alarm system that includes a video camera and one or more alarm sensors, which are positioned at a secured location. The security alarm system also includes a video server with means for receiving realtime video from the video camera and for receiving an alarm signal from an alarm sensor. The security alarm system further includes a central station with means for processing and displaying the realtime video which is received from the video server over an Internet connection. Finally, the system includes a mobile emergency response unit with mobile means for processing and displaying the realtime video over an Internet connection.

In accordance with still another embodiment of the present invention, the aforementioned and other objectives are achieved through a method which provides realtime video in a security alarm system. The method involves generating a realtime video signal at a secured location and transmitting that video in realtime from the secured location to an emergency response agency over a communications link. The method also involves displaying the realtime video at the emergency response agency.

In accordance with yet another embodiment of the present invention, the aforementioned and other objectives are achieved through a method for obtaining realtime video of a secured location. The method involves establishing an Internet link between a first IP address and a second IP address, where the second IP address corresponds with the secured location. The method also involves activating a video camera at the secured location, where the video camera is associated with a security alarm system. Realtime video is then transmitted from the video camera to the communications device at the first IP address, where it is displayed.

BRIEF DESCRIPTION OF THE DRAWINGS

Other objects and advantages of the present invention will become apparent to those skilled in the art from the following detailed description when read in conjunction with the accompanying drawings wherein.

DETAILED DESCRIPTION OF THE PREFERRED EMBODIMENTS

To facilitate an understanding of the present invention, reference will be made to a "secured location." It will be understood that the term "secured location" refers to a residence, a commercial location or any other location, outside or inside, which is protected by a security alarm system according to exemplary embodiments of the present invention. Furthermore, it will be understood that the term "alarm" refers to any type of alarm, unless otherwise specified, such as an alarm which is activated in response to a forced/unauthorized entry, smoke/fire, a medical emergency or manual alarm activation.

Figure 1:
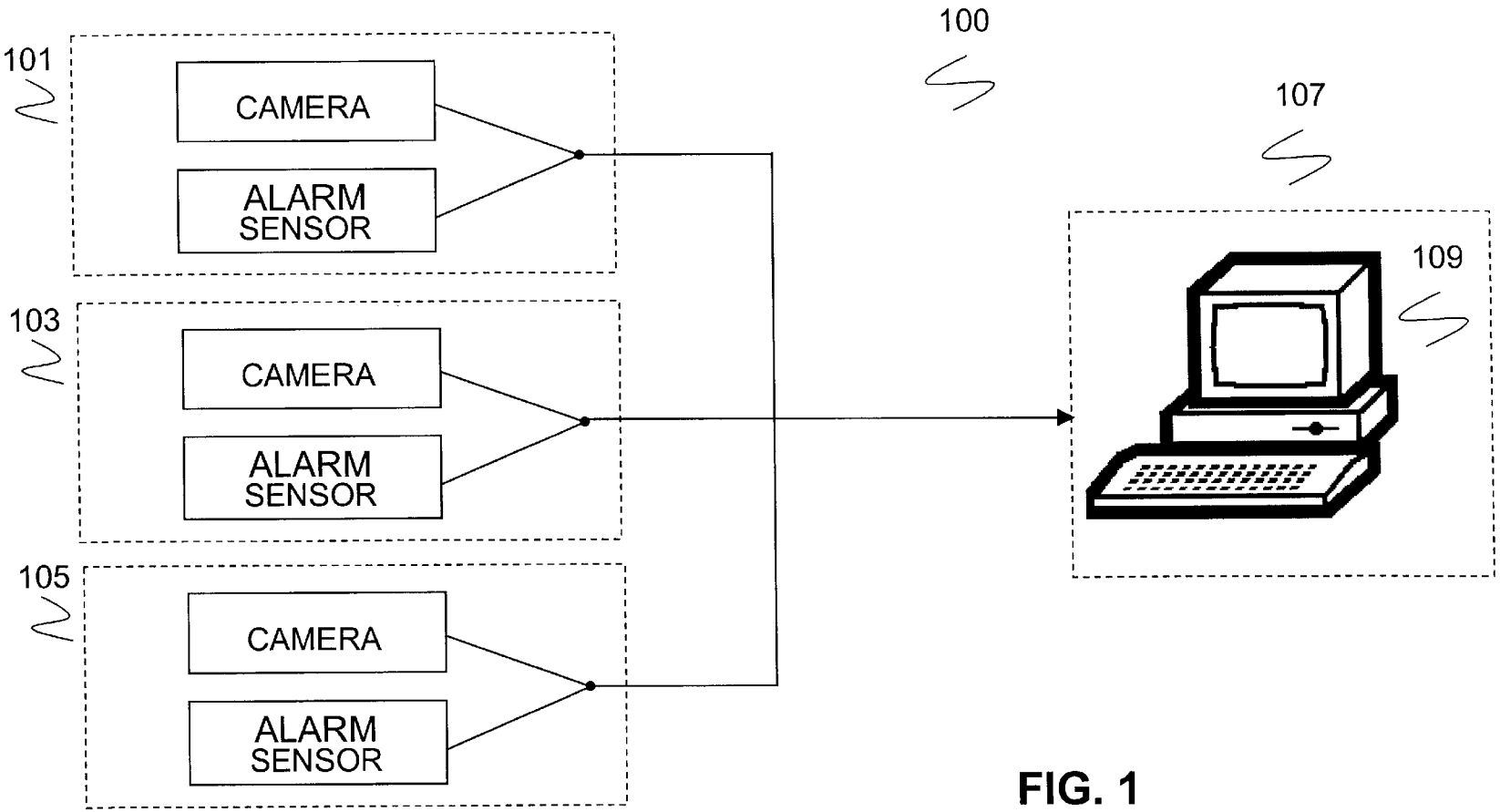
FIG. 1 (PRIOR ART)
FIG. 1 is a diagram illustrating a conventional security alarm system with video capability.

FIG. 1 illustrates a conventional security alarm system 100 which has a video capability. As shown, the system 100 includes at least one camera and one or more alarm sensors (i.e., transducers) positioned at a number of secured locations 101–105. The security system 100 also includes a central monitoring station 107 which is typically staffed by personnel employed by a security service. At the central station 107, there is equipment 109 including computer hardware and software that is capable of receiving, processing and displaying the video information which is transmitted from one or more secured locations.

The security alarm system 100 depicted in FIG. 1 works in the following manner. When one or more of the alarm sensors positioned, for example, at the secured location 103 detect an alarm condition, an alarm notification signal is transmitted from the secured location 103 to the central station 107, along with a video signal. The video signal is then processed and displayed for security service personnel, who may proceed by placing a telephone call to the secured location 103 to verify the alarm. If the alarm is confirmed, the security service personnel will typically call the local 911 operator, who then relays the information (i.e., the alarm notification) to the appropriate emergency response agency. The emergency response agency, based solely on the telephone call from the 911 operator, then dispatches their own personnel, with little or no additional information which might have been otherwise provided by the video.

Figure 2:
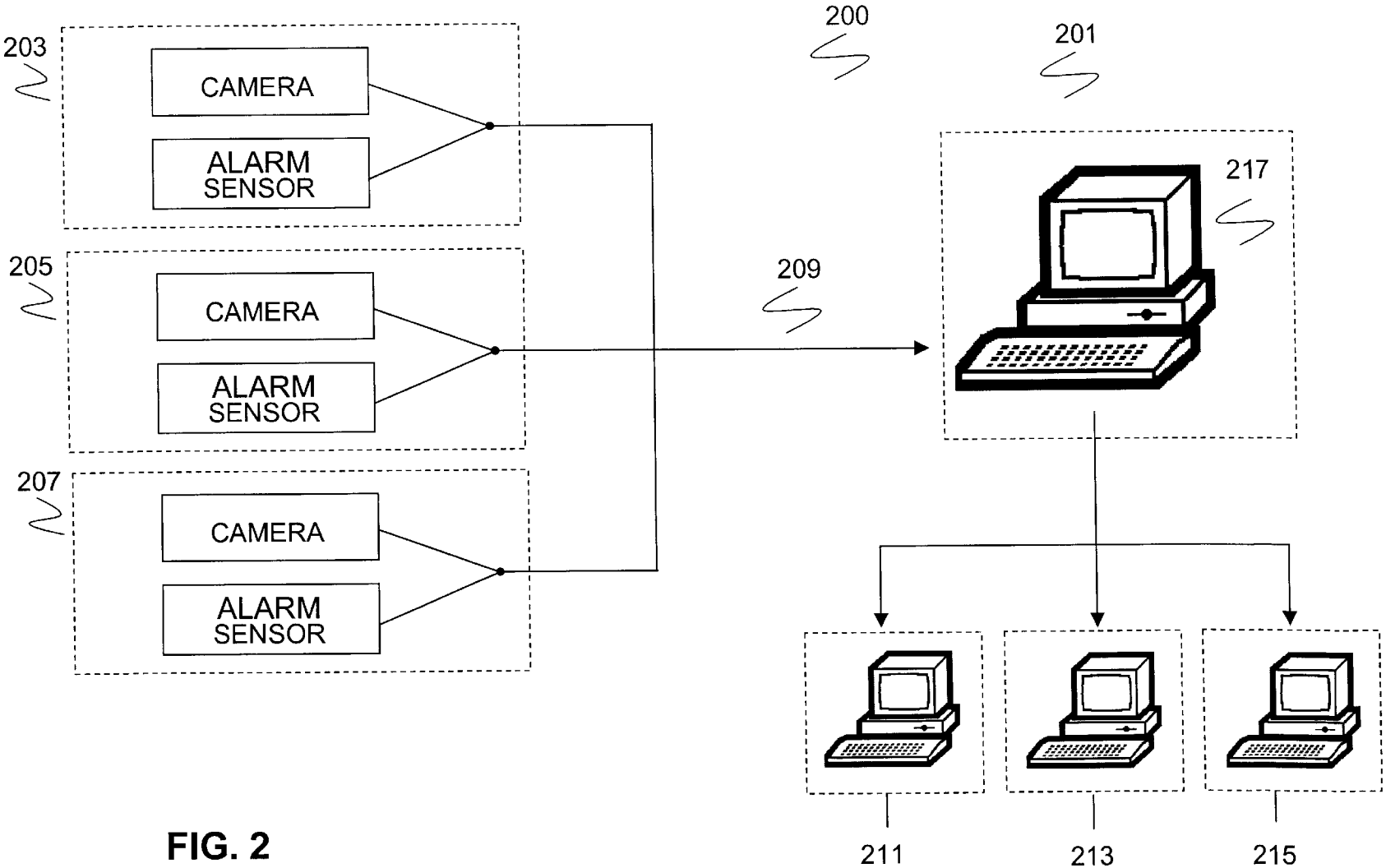
FIG. 2 is a diagram illustrating a security alarm system in accordance with exemplary embodiments of the present invention.

FIG. 2 illustrates a security alarm system 200 in accordance with exemplary embodiments of the present invention. As shown, there is a central monitoring station 201 which is connected to a number of secured locations 203–207 via a high-speed communications link 209 (e.g., a high-speed telephone or cable connection). At each secured location 203–207, there is at least one video camera and one or more alarm sensors. The central station 201 is also connected via a high-speed communications link to one or more emergency response agencies 211–215.

If an alarm sensor positioned at secured location 203, for example, detects an alarm condition, an alarm notification signal and a realtime video signal are transmitted to the central monitoring station 201 over the high-speed communications link 209. At the central station 201, the realtime video is received, processed and displayed using the computer system 217. This provides the security service personnel at the central station 201 with realtime video of the secured location 203.

In accordance with exemplary embodiments of the present invention, the video signal is simultaneously transmitted from the central station 201 to the one or more emergency response agencies 211–215. Computer systems located at each of the emergency response agencies 211–215, similar to the computer system 217 maintained at the central station 201, are employed to receive, process and display the realtime video. In a preferred embodiment of the present invention, the video would only be displayable at an emergency response agency upon entry of a valid password, thus preventing unauthorized individuals from accessing the video. By providing realtime video to the emergency response agencies 211–215, the trained personnel at these agencies are better equipped to assess a potential emergency in realtime, as they have been trained to do, and make more timely and informed decisions regarding the way in which they respond.

Figure 3:
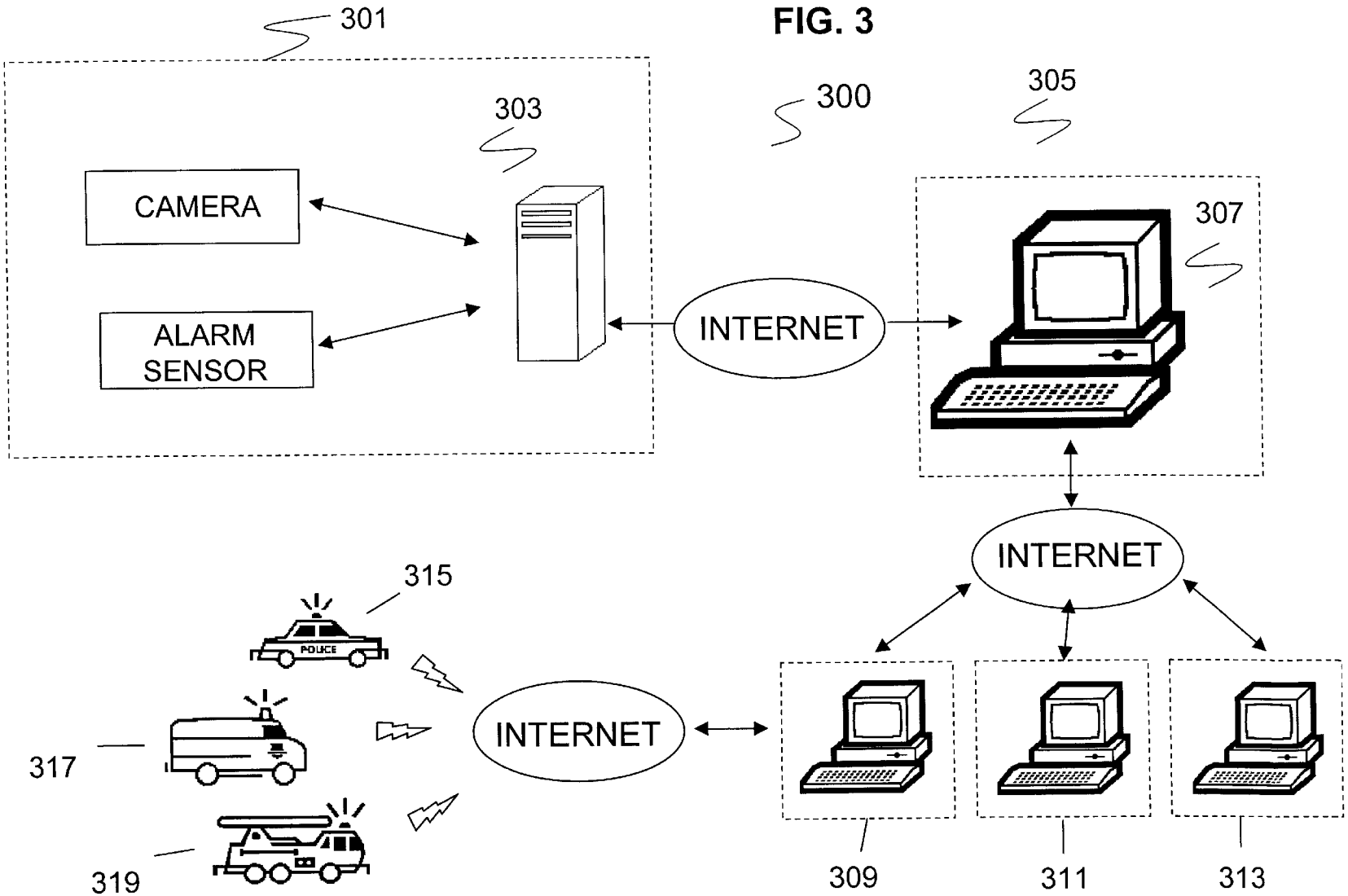
FIG. 3 is a diagram illustrating a security alarm system providing realtime video for one or more emergency response agencies and emergency response personnel, in accordance with exemplary embodiments of the present invention.

FIG. 3 illustrates, in greater detail, a security alarm system 300 for a given secured location 301, in accordance with exemplary embodiments of the present invention. As shown, there is at least one camera and one or more alarm sensors positioned at the secured location 301. The at least one camera and the one or more alarm sensors communicate with a video server 303 over a hardwired and/or wireless connection.

The security alarm system 300 includes a computer system 307 located at the central monitoring station 305. The computer system 307, which comprises hardware and software, is configured to communicate with the video server 303 over a high-speed communications link 304. In the embodiment illustrated in FIG. 3, the communications link 304 is achieved over the Internet, using hardwire (e.g., high-speed telephone or cable lines) and/or wireless technology. The computer system 307 is also configured to communicate with computer systems, including hardware and software, located at each of a number of emergency response agencies 309–313 over a high-speed communications link.

The embodiment illustrated in FIG. 3 shows that the realtime video may also be transmitted to various mobile emergency response units 315–319. In the case of the police department, a mobile emergency response unit may consist of one or more police officers in a police vehicle. In the case of the fire department, a mobile emergency response unit may consist of fire fighting personnel in a fire truck. In the case of an emergency medical team, the mobile response unit may consist of emergency medical technicians in an ambulance. As these emergency response units are mobile, the high-speed communications link between a corresponding emergency response agency, for example, emergency response agency 309 and mobile emergency response unit 315, is achieved, at least in part, by a wireless connection. As one skilled in the art will readily appreciate, the mobile equipment employed by the emergency response units 315–319 to receive, process and display the video might take the form of a laptop computer, a mobile telephone or personal digital assistant, or any other type of portable communications device that is capable of receiving, processing and displaying video over a high-speed communications link, such as an Internet link. By placing the video directly into the hands of the emergency response units, those who are specifically charged with responding to a potential emergency now have a great deal more information to assist them in assessing and responding to the emergency situation.

Figure 4:
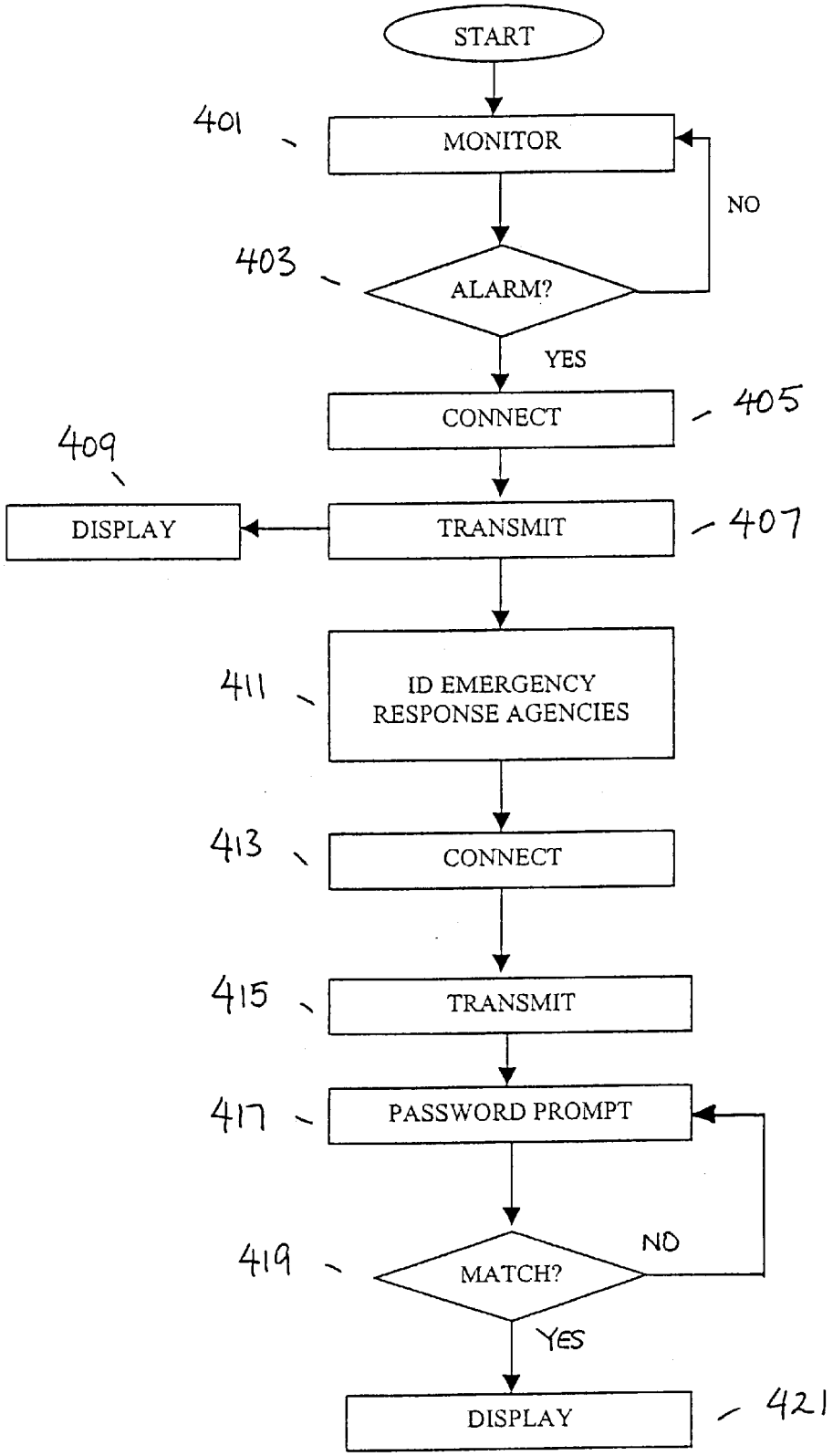
FIG. 4 is flowchart illustrating a method for providing secure, realtime video of a secured location to an emergency response agency, in accordance with exemplary embodiments of the present invention.

FIG. 4 is a flowchart depicting a method of providing realtime video for various emergency response agencies over high-speed communications links in conjunction with a security alarm system, such as the security alarm system 300 in FIG. 3. It will be understood that this method is exemplary and that other methods employing steps similar to those described below may be used to achieve similar results. It will be further understood that this method may be implemented through a combination of computer hardware and software associated with the video server 303 at the secured location 301, the computer systems located at the central station 305 and the one or more emergency response agencies 309–313 and, if applicable, the communications devices associated with the mobile emergency response units 315–319.

Referring first to step 401, the video server 303, following a power-on and initialization process, monitors the status of the one or more sensors positioned at the secured location 301. This step may involve, for example, repeatedly determining the value of a multi-bit data register, where each bit reflects the status of a corresponding alarm sensor. If, in accordance with the "NO" path out of decision step 403, it is determined that the status of the one or more alarm sensors has not changed (i.e., that there is no indication of an alarm situation), the video server 303 will continue to monitor the status of the sensors. If, however, the video server 303 detects a change in the status of one or more alarm sensors, in accordance with the "YES" path out of decision step 403, the video server 303 initiates the process of establishing an Internet connection with the computer system 307 located at central station 305 using the Internet Protocol (IP) address of the video server 303 and the IP address of the computer system 307, as shown by step 405. As soon as the connection is established, the video server 303 transmits an alarm notification signal to the computer system 307, as well as a realtime video signal associated with one or more cameras positioned at the secured location 301, per step 407.

Upon receiving the alarm notification signal at the central station 305, the realtime video information associated with the realtime video signal is displayed using computer system 307, as indicated by step 409. In a preferred embodiment, information identifying the secured location 301 (e.g., a name or postal address associated with the secured location) is simultaneously displayed along with any other pertinent information that might be of assistance to the security service personnel at the central station 305.

Upon receiving the alarm notification signal at the central station 305, a number of emergency response agencies associated with the secured location 301 are identified, as shown in step 411. The process of identifying and, for that matter, selecting these agencies may be achieved by maintaining the identity (e.g., the IP address) of all possible emergency response agencies in a memory associated with the computer system 307. The selection and identification of specific agencies, from amongst the list of all possible agencies, will depend on a number of factors. One factor may be the type of alarm generated at the secured location 301. For this to be a factor, the alarm notification signal transmitted by the video server 303 must identify the type of alarm which triggered the transmission of the alarm notification and realtime video signals. Moreover, the computer system 307 must be capable of distinguishing or extracting that information from the alarm notification signal. Another factor may be the address (i.e., the postal address) of the secured location. Thus, for example, if the video server 303 transmits an alarm notification signal indicating an unauthorized entry at 115 East Main Street, the police department or, if appropriate, a particular police precinct responsible for the geographical region covering 115 East Main Street would be identified and selected as a result of step 411. If, on the other hand, the alarm notification signal indicated a fire at 115 East Main Street, the fire department would be identified and selected as a result of step 411.

In accordance with step 413, once the appropriate emergency response agency (or agencies) has been identified and selected, an Internet connection is established between the computer system 307 and the computer system located at the identified and selected emergency response agency, for example, emergency response agency 309. Again, the Internet connection would be based on the IP address of computer system 307 and the IP address of the computer system at the emergency response agency 309. Then, in accordance with a preferred embodiment and step 415, the computer system 307 begins transmitting the realtime video signal to the computer system located at the emergency response agency 309 via the Internet connection.

In order to prevent unauthorized persons from accessing the realtime video signal, the computer system at the emergency response agency 309 prompts the operator to enter a secure password, as shown in step 417. If the operator does not enter a valid password, in accordance with the "NO" path out of decision step 419, the computer system at the emergency response agency 309 will reprompt the operator. After a number of unsuccessful attempts to enter a valid password, the connection between the computer system 307 and the computer at emergency response agency 309 may be terminated. In an alternative embodiment, the computer system 307 may, after the establishment of the Internet connection with the computer system located at emergency response agency 309, require that a valid password be entered before transmitting the realtime video signal to the emergency response agency 309. In either case, the entry of a valid password, in accordance with the "YES" path out of decision step 419 results in realtime video being simultaneously displayed on the computer equipment located at the central station 305 and the emergency response agency 309, per method steps 409 and 421.

If, as shown in FIG. 3, the realtime video signal is forwarded from the computer system located at the emergency response agency 309 to communications equipment associated with one or more mobile response units 315–319, method steps 413–421 depicted in FIG. 4, or substantially similar steps would be executed. The result would include the establishment of an Internet connection between the computer system located at the emergency response agency 309 and the communications equipment associated with one or more mobile response units 315–319, based on the IP address of the computer system at the emergency response agency 309 and the present mobile IP address of communications equipment associated with each of the one or more mobile response units 315–319, where it will be understood that mobile IP addresses may change during the existence of the Internet connection depending upon the geographical location of the corresponding mobile response unit and the strength of the network signal over which the mobile unit is communicating.

In another embodiment of the present invention, an Internet connection may be established between the video server 303 at the secured location and a computer system located at one or more emergency response agencies 309–313. As such, realtime video would be transmitted from the video server 303 directly to the one or more emergency response agencies. However, there are advantages associated with routing the realtime video signal through the security service central station 305. One important advantage is, the security service personnel at the central station 305 may be able to prevent the transmission, or terminate the transmission, if it is determined that the alarm is false, before the emergency response agency expends time and manpower responding to the alarm.

In still another alternative embodiment, the video server 303, as mentioned above, may transmit a video signal that includes video from multiple cameras positioned at the secured location 301. If this is the case, the computer system 307 located at the central station 305 will distinguish video information associated with one camera from video information associated with another camera. This may, for example, be accomplished by including an identification code in the header portion of each video packet transmitted from the video server 303, where the identification code identifies the video information contained in the corresponding video packet as being associated with a specific one of the multiple cameras. Further in accordance with this alternative embodiment, the central station 305, by virtue of its ability to distinguish one stream of video information from another, the computer system 307 at the central station 305 can display the video associated with each of the multiple cameras either separately, simultaneously, selectively or in a repetitive, cyclical sequence.

Figure 5:
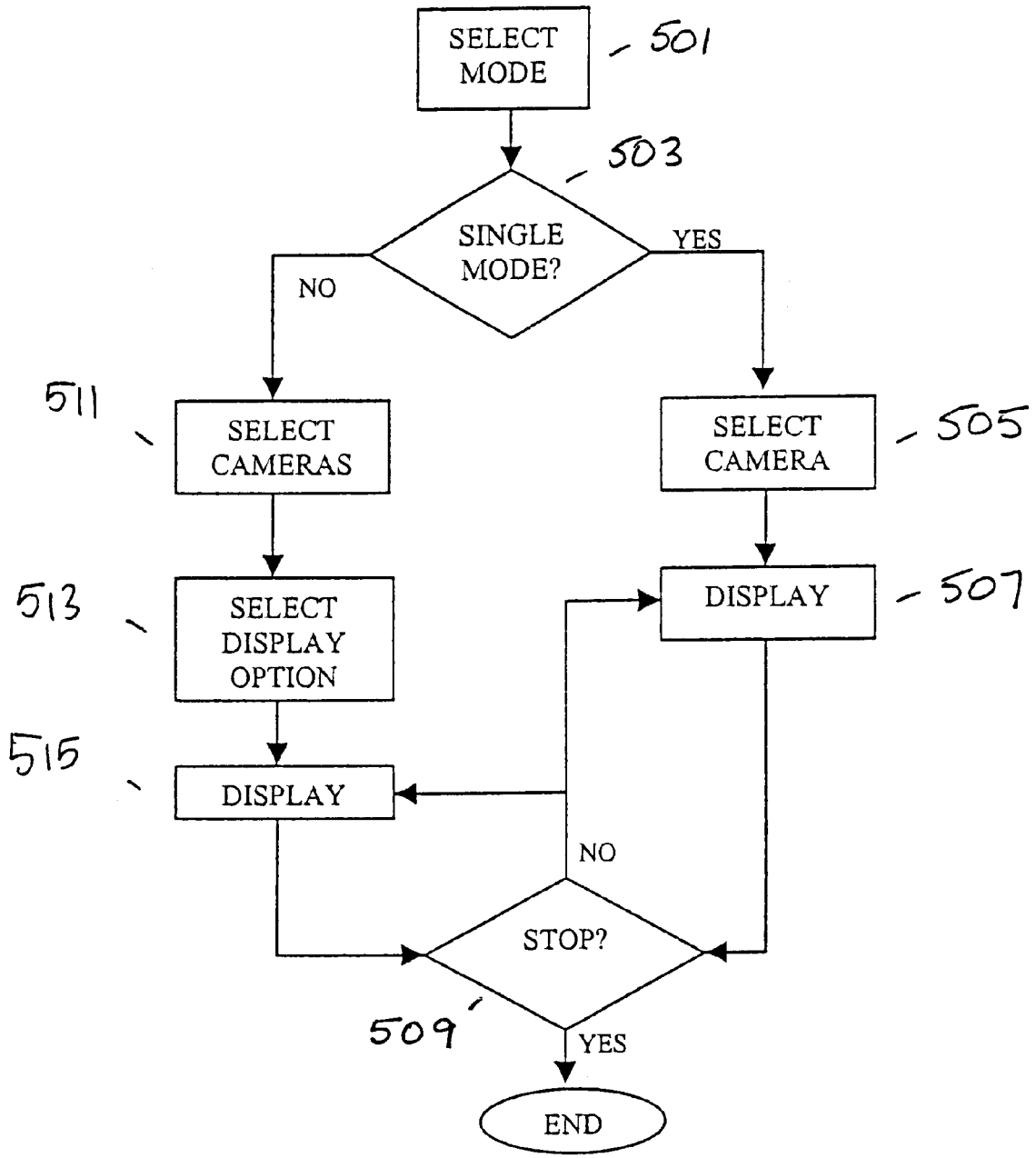
FIG. 5 is a flowchart illustrating a method for selecting one or more cameras which provide realtime video for use in a security alarm system, in accordance with exemplary embodiments of the present invention.

FIG. 5 is a flowchart depicting an exemplary method that may be employed to handle the selection and display of video from multiple cameras positioned at a secured location. As shown in step 501, the operator at the central station 305, and/or the operator at the emergency response agency 309 selects single camera or, if applicable, multiple camera mode. If the operator selects the single camera mode, in accordance with the "YES" path out of decision step 503, the operator then selects the camera or particular video stream of interest, per step 505. Step 505 may be achieved by displaying a list of cameras from which the operator may select. If there is only one camera positioned at the secured location 301, step 505 may be accomplished automatically, without the need for the operator to make a selection. The video associated with the selected camera would then be displayed, per method step 507 and the "NO" path out of decision step 509, until the process is terminated according to the "YES" path out of decision step 509.

If the operator selects the multiple camera mode, in accordance with the "NO" path out of decision step 503, the operator then selects the cameras or video streams of interest, as shown in step 511. The operator then selects the display option according to step 513. As stated, the various display options may include simultaneously displaying each of the multiple video streams, for example, on a split screen or multiple screens, or by displaying each on a full screen in a repeating sequence. The video would then be displayed, according to step 515, based on the operator selections, until the process is terminated per the "YES" path out of decision step 509.

Thus far, the present invention has been described in terms of a security alarm system in which realtime video information is transmitted from a video server at a secured location to an appropriate emergency response agency, and possibly, to appropriate mobile emergency response units via a security service central station over high-speed communications links. However, one of ordinary skill in the art will appreciate other uses for the present invention. One such alternative use is the ability for a homeowner or business owner (herein "the client") to periodically check on the secured location. Assuming the high-speed communications link is, once again, implemented over the Internet, the client connects to a web-site associated with the security service central station. Then, through selectable on-screen options, the client establishes a connection with the video server at his or her place of residence or business. Realtime video would then be transmitted to the client, who could then display the video on a desktop or mobile communication device, including an Internet capable mobile telephone or personal digital assistant. Thus, for example, a homeowner would be able to check on things at home, an anxious parent would be able to check on a child, and a business owner would be able to make sure things were secure at his or her place of business.

Since numerous additional modifications and alternative embodiments of the invention will be apparent to those skilled in the art in view of the foregoing description, the above description is to be construed as illustrative only, and is for the purpose of teaching those skilled in the art the best mode of carrying out the invention. The details of the present invention described above may be varied substantially without departing from the spirit of the invention, and the exclusive use of any modification which comes within the scope of the appended claims is reserved.

What is claimed is:

1. A security alarm system comprising:

a video camera and an alarm sensor positioned at a secured location;

means, located at a security system central station, for receiving, processing and displaying realtime video generated by said video camera and received over a communications link;

means for transmitting the realtime video from the central station to an emergency response agency over a communication link; and means, located at the emergency response agency, for receiving, processing and displaying realtime video generated by said video camera.

2. The security alarm system of claim 1 further comprising means for transmitting realtime video from the secured location over a communications link, in response to an alarm signal associated with said alarm sensor.

3. A security alarm system comprising:

a video camera and one or more alarm sensors positioned at a secured location;

a video server including means for receiving realtime video from said video camera and for receiving an alarm signal from one of said alarm sensors;

means, located at a security system central station, for receiving, processing and displaying said realtime video which is received from said video server over an Internet connection; and means, associated with a mobile emergency response unit, for receiving, processing and displaying said realtime video received from the central station over an Internet connection.

4. The security alarm system of claim 3 further comprising:

means, located at an emergency response agency, for receiving, processing and displaying said realtime video which is received from said central station over an Internet connection, and means for transmitting said realtime video to said mobile emergency response unit over an Internet connection.

5. The security alarm system of claim 3 wherein said video server comprises:

means for transmitting said realtime video to said central station in response to the alarm signal.

6. A method of providing realtime video in a security alarm system, said method comprising the steps of:

generating a realtime video signal at a secured location;

transmitting the realtime video signal from the secured location to a security system central station over a communications link;

transmitting the realtime video signal from the central station to the an emergency response agency over a communications link; and displaying realtime video of the secured location at the emergency response agency based on the realtime video signal transmitted from the secured location.

7. The method of claim 6 further comprising the step of:

generating an alarm signal at the secured location, wherein generating and transmitting the realtime video signal is dependent upon prior generation of an alarm signal at the secured location.

8. The method of claim 6, where the communications links are Internet connections.

9. The method of claim 6 further comprising the step of:

entering a password at the emergency response agency, wherein said step of displaying realtime video at the emergency response agency is dependent upon entry of a valid password.

10. The method of claim 6 further comprising the step of:

entering a password at the emergency response agency, wherein said step of transmitting the realtime video signal from the central station to the emergency response agency is dependent upon entry of a valid password.

11. The method of claim 5 further comprising the step of:

transmitting the realtime video signal from the emergency response agency to an emergency response unit over a wireless communications link.

12. The method of claim 5 further comprising the step of:

identifying the emergency response agency from amongst a list of emergency response agencies.

13. The method of claim 12 wherein said step of identifying the emergency response agency from amongst a list of emergency response agencies is a function of the secured location.

14. The method of claim 12 wherein said step of identifying the emergency response agency from amongst a list of emergency response agencies is a function of an alarm signal.

15. The method of claim 5 wherein the realtime video signal comprises multiple video streams, and wherein each of the multiple video streams is associated with a corresponding camera at the secured location.

16. The method of claim 15 further comprising the steps of:

selecting a video display mode, wherein said step of displaying realtime video at the emergency response agency is a function of the selected video display mode.

* * * * *

UNITED STATES PATENT AND TRADEMARK OFFICE

CERTIFICATE OF CORRECTION

PATENT NO. : 6,798,344 B2
DATED : September 28, 2004
INVENTOR(S) : James Otis Faulkner et al.

It is certified that error appears in the above-identified patent and that said Letters Patent is hereby corrected as shown below:

Title page,
Item [75], Inventors, the second inventor should be -- Richard Marvel Blake --

Signed and Sealed this

First Day of February, 2005

JON W. DUDAS
*Director of the United States Patent and Trademark Office*